US012611037B2

(12) United States Patent
Deng

(10) Patent No.: US 12,611,037 B2
(45) Date of Patent: Apr. 28, 2026

(54) ADJUSTABLE MULTI-USE CHAIR

(71) Applicant: NEWTRAL FURNITURE TECHNOLOGY INC., Shenzhen (CN)

(72) Inventor: Jianbo Deng, Shenzhen (CN)

(73) Assignee: NEWTRAL FURNITURE TECHNOLOGY INC., Shenzhen (CN)

( * ) Notice: Subject to any disclaimer, the term of this patent is extended or adjusted under 35 U.S.C. 154(b) by 199 days.

(21) Appl. No.: 18/591,239

(22) Filed: Feb. 29, 2024

(65) Prior Publication Data

US 2025/0248525 A1 Aug. 7, 2025

Related U.S. Application Data

(63) Continuation of application No. PCT/CN2024/075524, filed on Feb. 2, 2024.

(30) Foreign Application Priority Data

Feb. 1, 2024 (CN) ..... 202420245158.4

(51) Int. Cl.

| | |
|---|---|
| ***A47C 7/02*** | (2006.01) |
| ***A47C 1/024*** | (2006.01) |
| ***A47C 1/03*** | (2006.01) |
| ***A47C 7/40*** | (2006.01) |
| ***A47C 7/44*** | (2006.01) |
| ***A47C 7/48*** | (2006.01) |

(Continued)

(52) U.S. Cl.

CPC ..... *A47C 7/407* (2013.01); *A47C 1/0244* (2013.01); *A47C 1/03* (2013.01); *A47C 1/0308* (2018.08); *A47C 7/024* (2013.01); *A47C 7/402* (2013.01); *A47C 7/44* (2013.01); *A47C 7/48* (2013.01); *A47C 7/54* (2013.01); *A47C 7/541* (2018.08); *A47C 7/543* (2013.01); *A47C 7/70* (2013.01)

(58) Field of Classification Search

CPC ..... A47C 7/024; A47C 1/0244; A47C 7/407; A47C 7/44; A47C 7/48; A47C 1/03; A47C 1/0308; A47C 7/54; A47C 7/541; A47C 7/543

USPC ..... 297/107, 116, 232, 233, 234, 235, 353, 297/354.11, 411.32, 411.37, 411.38

See application file for complete search history.

(56) References Cited

U.S. PATENT DOCUMENTS 137,062 A * 3/1873 Croghan ..... A47C 17/12 297/119

156,177 A * 10/1874 Schabel et al. ..... A47C 17/12 297/116

(Continued)

*Primary Examiner* — Rodney B White

(74) *Attorney, Agent, or Firm* — HOWARD M COHN and Associates, LLC

(57) ABSTRACT

An adjustable multi-use chair is provided with two adjustable chair backs and armrests, and the height of a first chair back is adjustable; an angle between a second chair back and a seat surface of a seat is adjustable, such that the second chair back can function as a chair back or a desk; and angles between inner sides of the two armrests and the seat surface of the seat can be separately adjusted to a plurality of angles from an acute angle to a reflex angle, and users can adjust the armrests according to their preferences to sit forward, lie on the side, sit laterally or backward on the chair and can change their sitting position without being limited by the armrests; and the whole chair is easy to adjust and can be adjusted in multiple ways to satisfy different adjustment requirements of users.

7 Claims, 8 Drawing Sheets

(51) Int. Cl.
*A47C 7/54* (2006.01)
*A47C 7/70* (2006.01)

(56) References Cited

U.S. PATENT DOCUMENTS 352,723 A * 11/1886 Weeden ..... B60N 2/3084
297/112
863,874 A * 8/1907 Rajner ..... A47C 17/18
297/411.27
1,025,266 A * 5/1912 Harman ..... A47C 17/12
297/116
2,790,485 A * 4/1957 Franklin ..... A47C 17/12
297/116
5,630,649 A * 5/1997 Heidmann ..... A47C 1/03274
297/344.19
6,155,645 A * 12/2000 Bedrich ..... A47C 1/0355
297/344.19 X
6,352,308 B1 * 3/2002 Chen ..... A47C 7/004
297/344.19 X
6,425,633 B1 * 7/2002 Wilkerson ..... A47C 1/03272
297/344.19 X
7,093,904 B1 * 8/2006 McMillen ..... A47C 7/543
297/411.32
9,693,634 B2 * 7/2017 Smith ..... A47B 83/021
10,427,552 B2 * 10/2019 Guy ..... B60N 2/58
10,912,423 B2 * 2/2021 Williams ..... A47K 3/282
11,717,089 B2 * 8/2023 Lazar ..... A47C 7/024
297/29
2002/0140277 A1 * 10/2002 Pan ..... A47C 3/30
297/344.19
2007/0290539 A1 * 12/2007 Hosoe ..... A47C 1/023
297/354.11
2009/0021065 A1 * 1/2009 Brauning ..... A47C 1/023
297/344.19

* cited by examiner

ADJUSTABLE MULTI-USE CHAIR

BACKGROUND OF THE INVENTION

1. Technical Field

The invention relates to the field of chairs, in particular to an adjustable multi-use chair.

2. Description of Related Art

Generally, office chairs are only suitable for the sitting position. With the gradual increase of the working time, people often need to continuously change their sitting position at work to relieve physical burdens caused by long-term sitting, which leads to a greater demand for chairs with a high degree of freedom of adjustment. For example, Chinese Patent No. CN112890486A discloses a novel multi-use chair which is provided with adjustable armrests and an adjustable chair back, and the angle of the chair can be adjusted freely, such that users can sit, lie on the back or lie on the side on the chair. In another example, US Patent US20220125205A1 discloses a multi-sitting position chair with adjustable armrests and an adjustable chair back, and the chair back can be folded to be horizontal to be used as a desk. However, all these chairs have the problem of complex adjustment, and users have to press locking structures on the chair back and armrests to realize adjustment; after the chair back is adjusted, the armrests cannot be accordingly lowered towards the chair leg, so when users turn around to sit on the chair, the users straddling on the chair will be severely interfered no matter whether the two armrests are placed erectly or horizontally, making it difficult for the users to change their sitting position; and after the chair back is adjusted into a desk, the users need to restore the chair back before turning back to sit on the chair again, otherwise, the user's back will not be supported; the users need to synchronously adjust the chair when changing their sitting position, and the adjustment is unsmooth, which will inevitably destroy the degree of freedom of the chair. Therefore, a multi-use chair easier to use needs to be developed.

BRIEF SUMMARY OF THE INVENTION

In view of the problem that adjustable chairs in the prior art are inconvenient to use, the invention provides an adjustable multi-use chair.

To fulfill the above objective, the invention provides an adjustable multi-use chair, comprising:

- a seat and a chair leg;
- two armrests respectively and symmetrically arranged on two sides of the seat;
- a first chair back and a connecting mechanism, wherein the first chair back is connected to the seat by means of the connecting mechanism and has an end connected to the connecting mechanism; a joint of the first chair back and the connecting mechanism extends in a direction away from the connecting mechanism and expands smoothly in a direction perpendicular to a central axis of the connecting mechanism to form a support part; the connecting mechanism comprises a chair back lifting device used for driving the first chair back to ascend to be adjusted and descend to return;
- a first angle adjustment mechanism; and
- a second chair back, wherein the second chair back is connected to the first chair back by means of the first angle adjustment mechanism, and the first angle adjustment mechanism has an end arranged on the support part and an end arranged on the second chair back; the first angle adjustment mechanism is used for adjusting an angle between a backrest surface of the second chair back and a seat surface of the seat to a plurality of angles from an acute angle to a reflex angle.

As an improvement of the application, the adjustable multi-use chair further comprises a second angle adjustment mechanism and a third angle adjustment mechanism, an end of the second angle adjustment mechanism and an end of the third angle adjustment mechanism are symmetrically arranged on the two sides of the seat respectively; the two armrests are connected to the seat by means of the second angle adjustment mechanism and the third angle adjustment mechanism respectively; the second angle adjustment mechanism and the third angle adjustment mechanism are used for adjusting angles between inner sides of the armrests and the seat surface of the seat to a plurality of angles from an acute angle to a reflex angle; and the two armrests are adjusted separately.

As an improvement of the application, each armrest is provided with an armrest bracket and an armrest bracket adjustment device, and the armrest bracket adjustment device has an end connected to the armrest bracket and an end fixed in the armrest and is used for adjusting a height of the armrest bracket; the armrest bracket adjustment device comprises a lifting rod, a lifting sleeve with a lifting positioning groove, and a positioning rod, a through hole allowing the positioning rod to penetrate through is formed in the lifting rod, and the positioning rod is arranged in the through hole; when the height of the armrest bracket is adjusted, the positioning rod slides in the lifting positioning groove; and after adjustment, the positioning rod is fixed in the lifting positioning groove.

As an improvement of the application, the second angle adjustment mechanism and the third angle adjustment mechanism each comprise a first rotating arm, a second rotating arm and a return spring, and the return spring is fixed to the first rotating arm and used for increasing return damping and guaranteeing that the second rotating arm returns to an initial state.

As an improvement of the application, a convex rib is arranged at an end, away from the seat, of the second chair back.

As an improvement of the application, a sitting depth adjustment mechanism is arranged at a joint of the connecting mechanism and the seat and has a plurality of adjustment positions for adjusting a distance from the first chair back to the seat.

As an improvement of the application, a pneumatic rod for adjusting a height and rotation direction of the chair is arranged in the chair leg.

As an improvement of the application, the seat comprises a cushion structure, and two ends of the cushion structure extend out of the seat and wrap around two ends of the seat.

The invention has the following beneficial effects: compared with the prior art, the adjustable multi-use chair provided by the invention has two adjustable chair backs, wherein a first chair back is used as a basic chair back to support the back of users; a second chair back has an adjustable deflection angle with respect to the first chair back; when the chair backs are not adjusted, one end of the second chair back is smoothly connected to one end of the first chair back, and the first chair back and the second chair back are both used for supporting the back of the users; when the users want to turn around to sit on the chair to work, the second chair back can be folded by 90° in a direction away from the seat, at this moment, the second chair back is parallel to the seat, and the users can place tablet computers, books or other items on the second chair back and use the second chair back as a desk; the second chair back can also be reversely folded to be attached to the first chair back, at this moment, the angle between the second chair back and the front surface of the seat is 270°, and the users can sit backward on the chair and work on the desk or table; and the side, connected to the second chair back, of the first chair back is a support part for supporting the hands of the users, and the joint between the first chair back and the seat is retracted inwards to provide a space allowing the users to place their thighs therein when the users sit backward on the chair, such that both the degree of freedom in use and the comfort are guaranteed to the maximum extent.

MAIN REFERENCE SIGNS

11, first chair back; 12, second chair back; 13, connecting mechanism; 14, first angle adjustment mechanism; 15, convex rib; 131, chair back lifting mechanism; 132, sitting depth adjustment mechanism; 1321, rotating handle; 1322, adjustment groove; 1323, limiting groove; 21, first armrest; 22, second armrest; 23, second angle adjustment mechanism; 231, first rotating arm; 232, second rotating arm; 233, return spring; 2311, fixing block; 2312, fixing elastic piece; 2321, tooth groove; 24, third angle adjustment mechanism; 25, armrest bracket; 26, armrest bracket adjustment device; 261, lifting rod; 262, lifting sleeve with lifting positioning groove; 263, positioning rod; 264, adjustment switch; 265, lifting rod inner sleeve; 266, armrest bracket outer sleeve; 267, through groove; 268, rotating shaft; 3, seat; 4, chair leg; 41, pneumatic rod.

DETAILED DESCRIPTION OF THE INVENTION

To more clearly explain the invention, the invention will be further described below in conjunction with accompanying drawings.

In the following description, details of embodiments are provided to gain a deeper understanding of the invention. Obviously, the embodiments in the following description are merely illustrative ones, and are not all possible ones of the invention. It should be understood that the specific embodiments are merely used for explaining the invention and are not intended to limit the invention.

It should be understood that terms "include" and/or "comprise" used in the specification refers to the presence of said feature, entity, step, operation, element or assembly and do not exclude the presence or addition of one or more other features, entities, steps, operations, elements, assemblies or combinations thereof.

Figure 1:
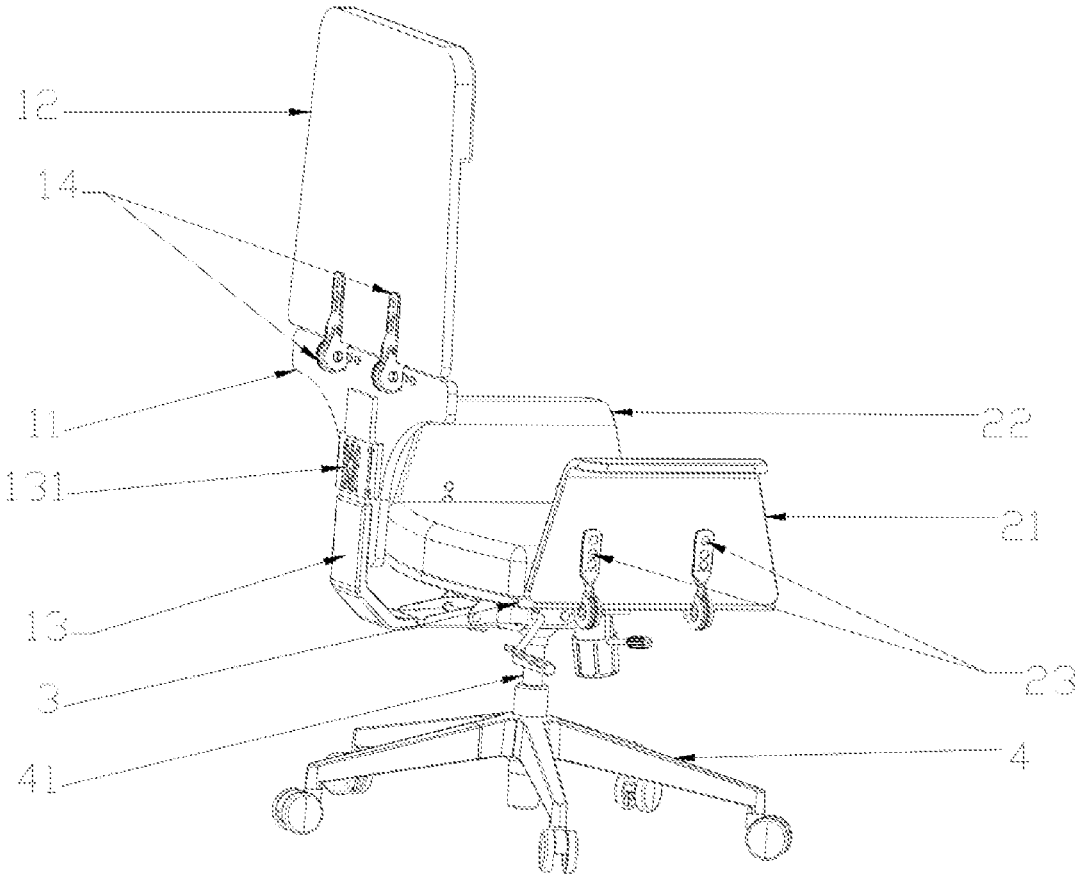
FIG. 1 is a schematic structural diagram of the invention.
Figure 2:
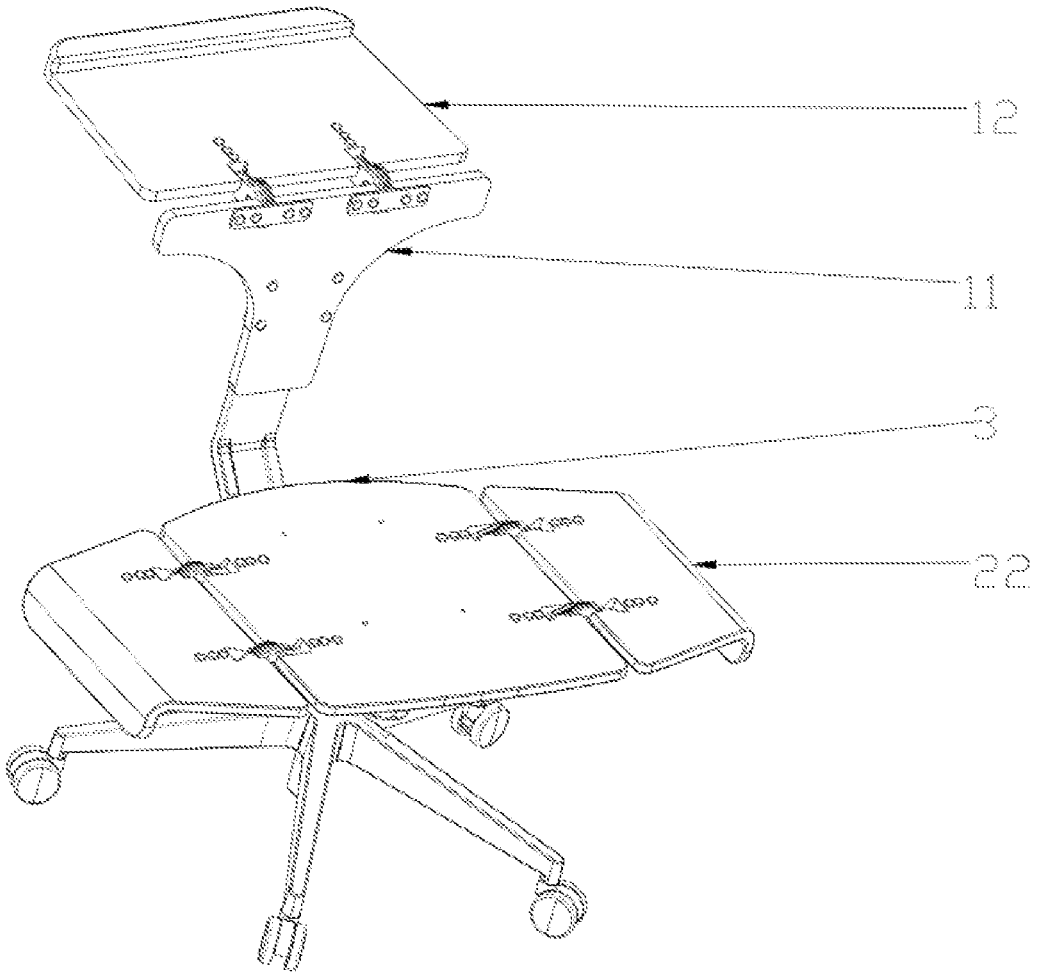
FIG. 2 is a schematic diagram of the invention in one state.
Figure 3:
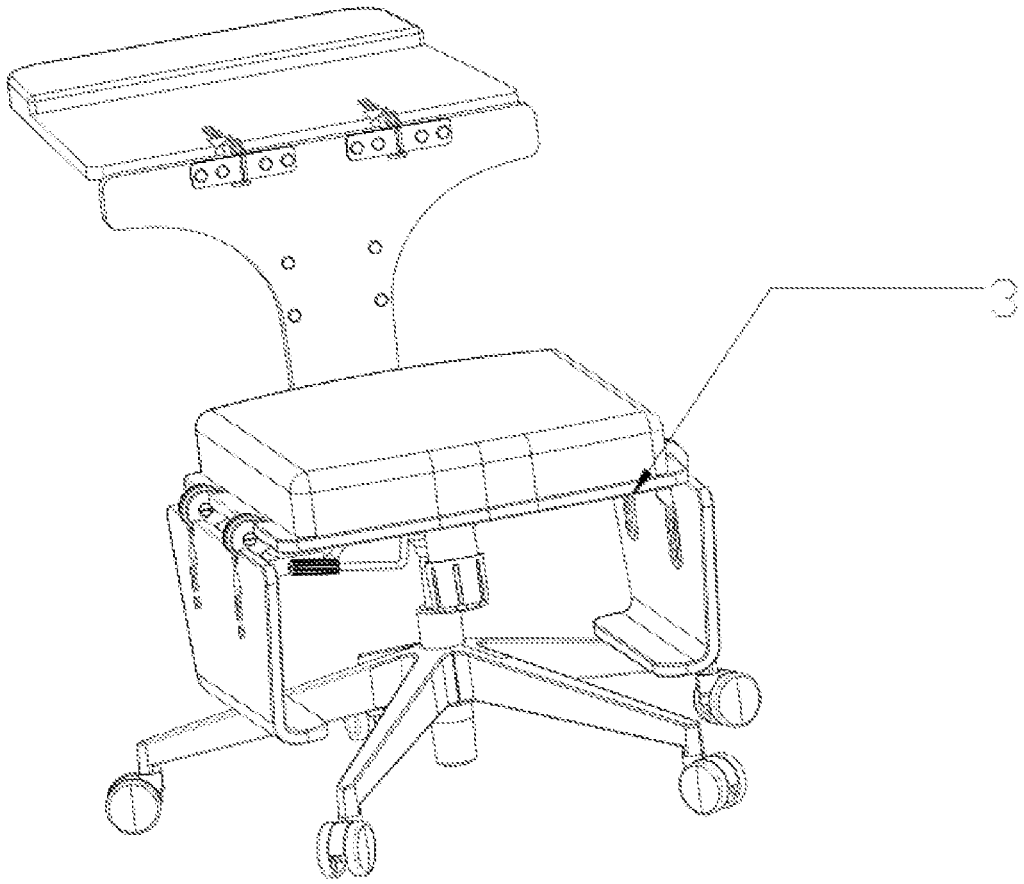
FIG. 3 is a schematic diagram of the invention in one state.
Figure 4:
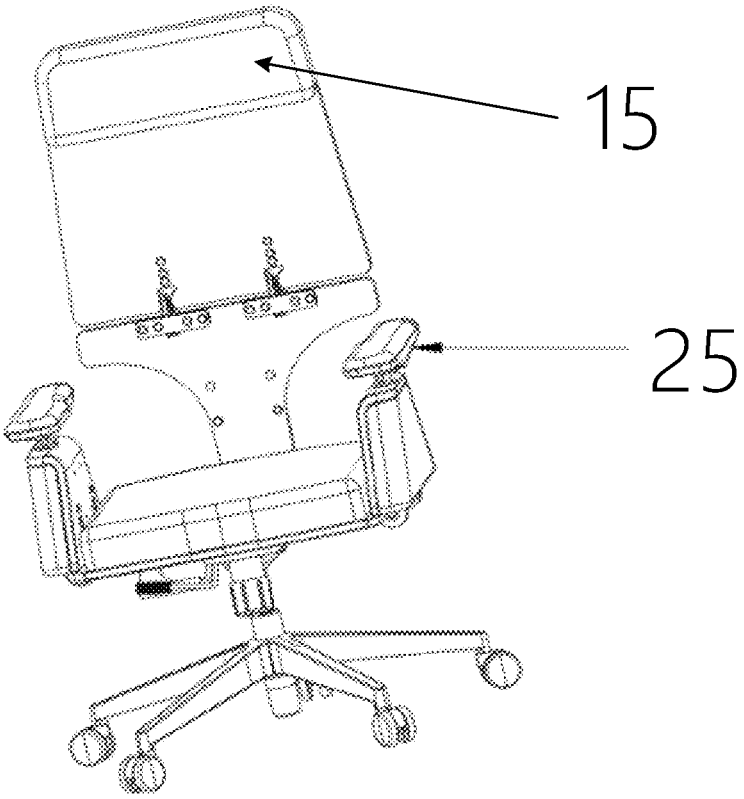
FIG. 4 is a schematic diagram of one embodiment of the invention.
Figure 5:
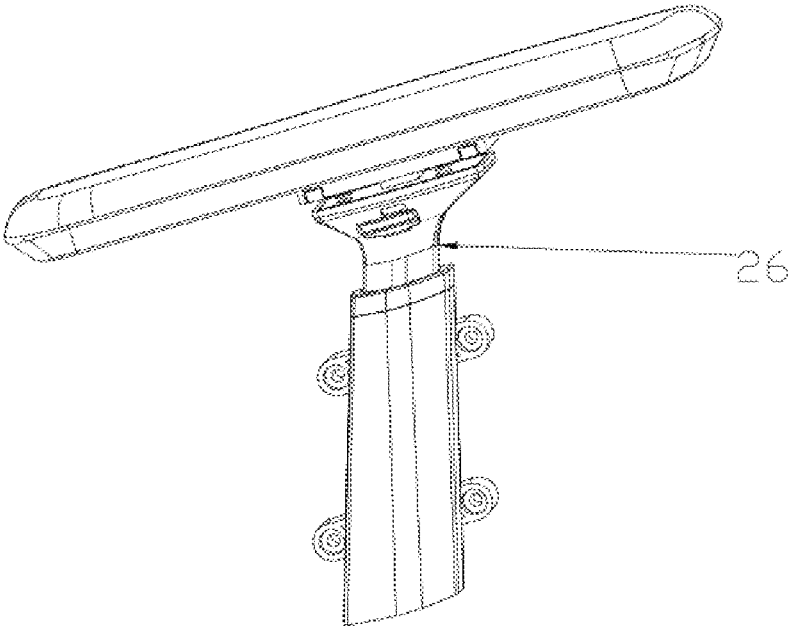
FIG. 5 is a schematic diagram of an armrest bracket of the invention.
Figure 6:
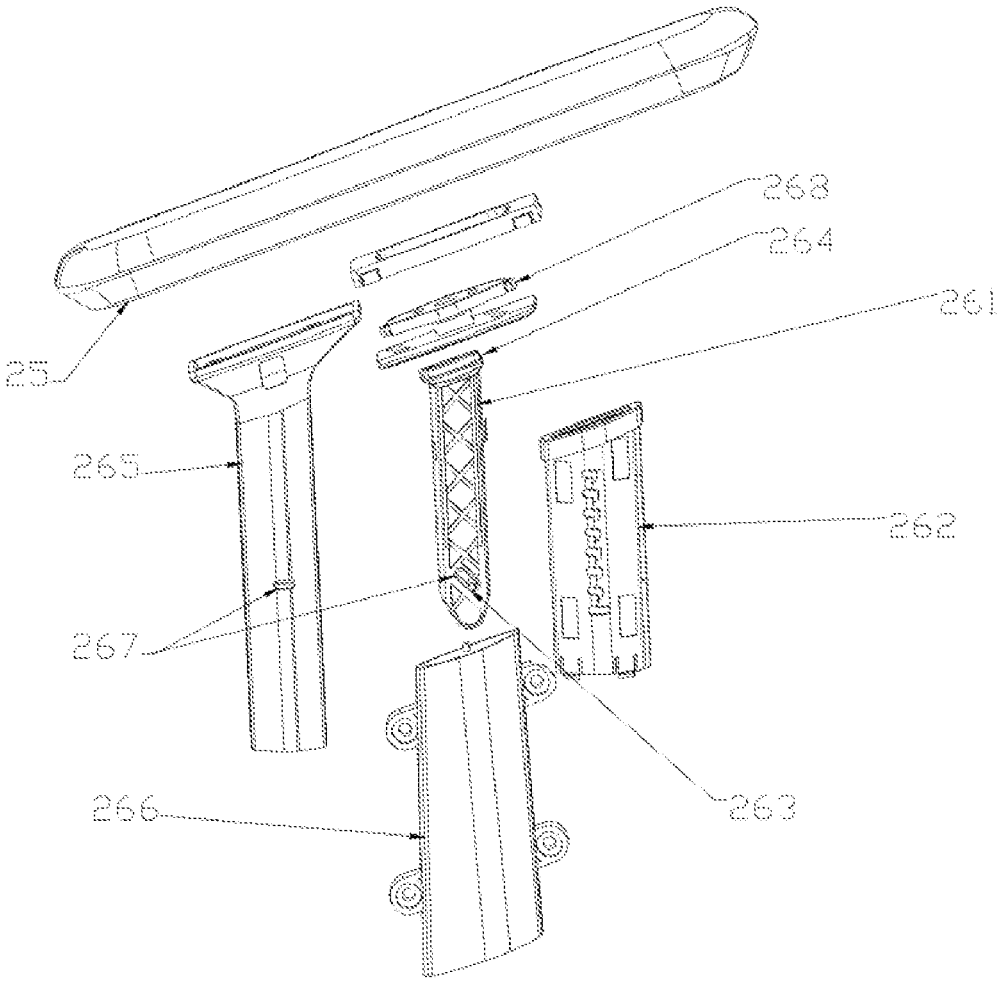
FIG. 6 is an exploded view of the armrest bracket of the invention.
Figure 7:
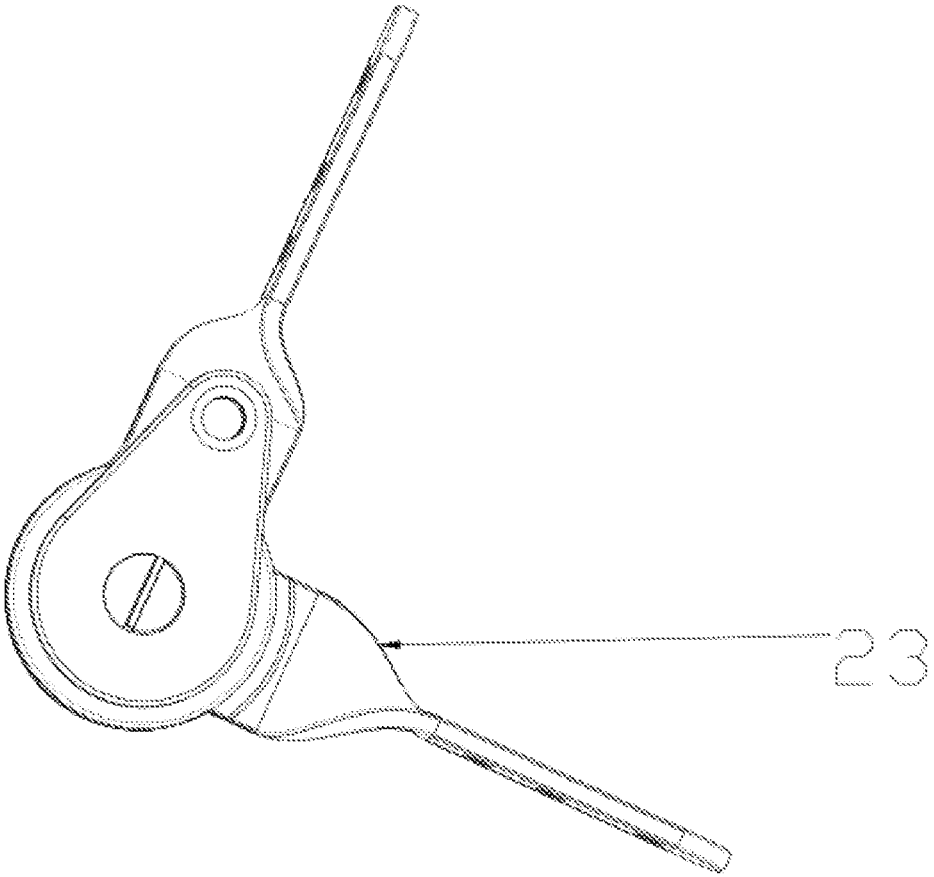
FIG. 7 is a schematic diagram of a second angle adjustment mechanism of the invention.
Figure 8:
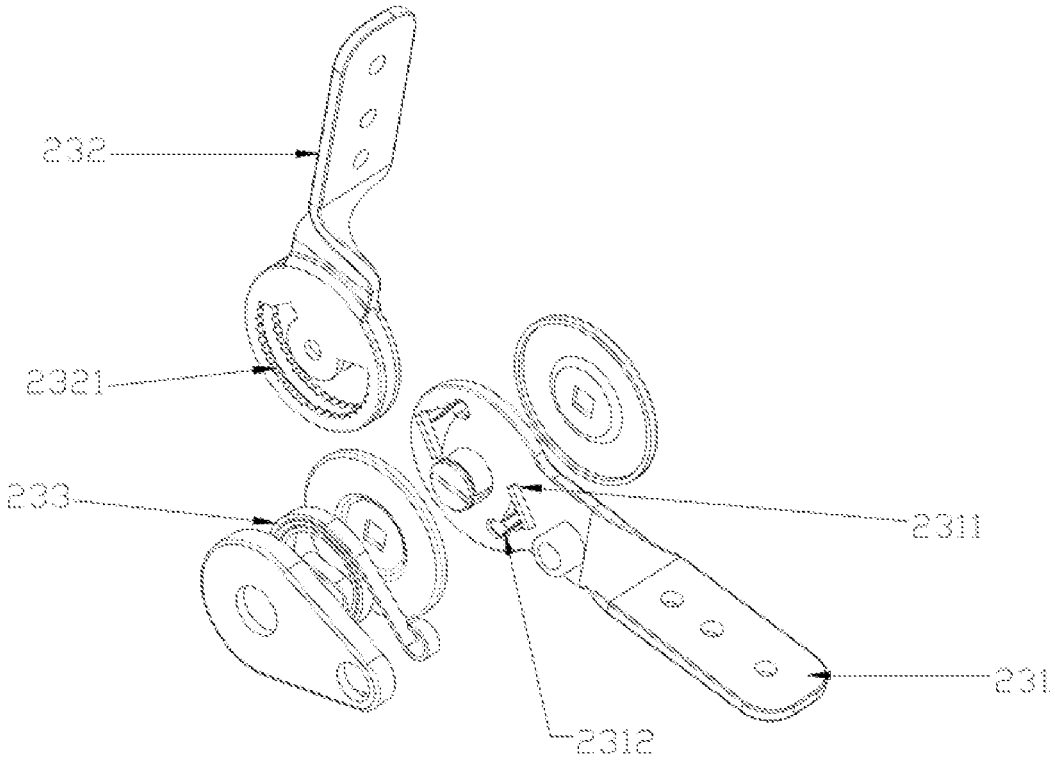
FIG. 8 is an exploded view of the second angle adjustment mechanism of the invention.
Figure 9:
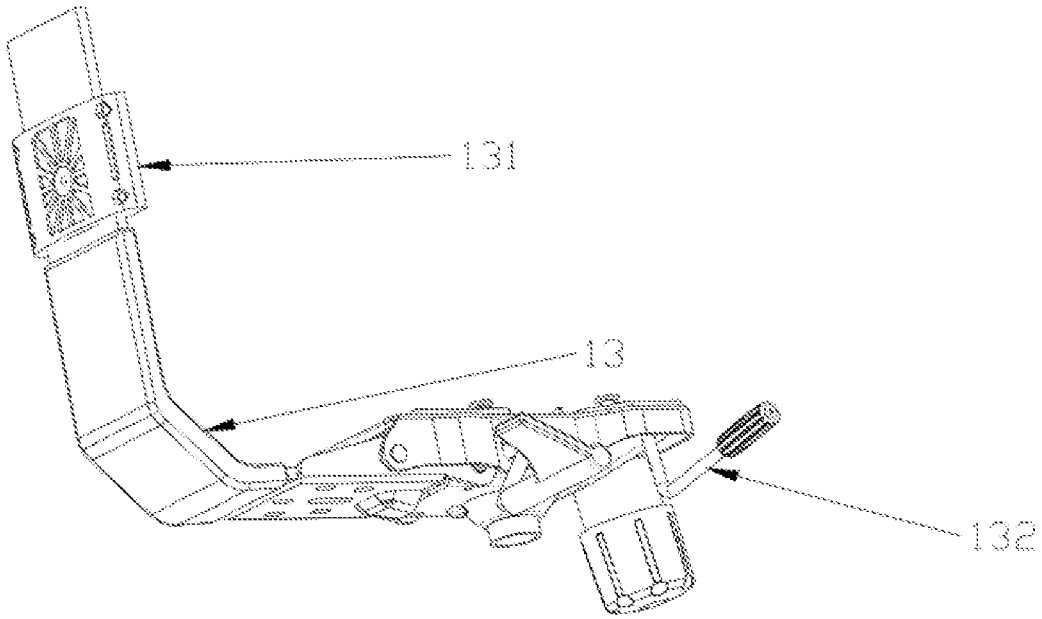
FIG. 9 is a schematic diagram of a connecting mechanism of the invention.
Figure 10:
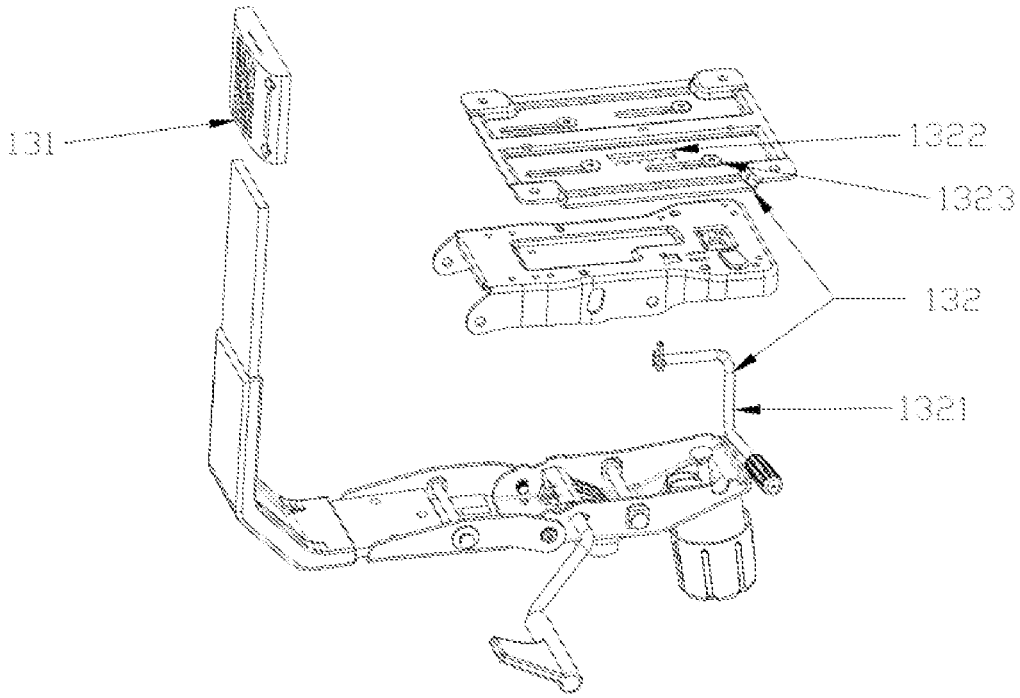
FIG. 10 is an exploded view of the connecting mechanism of the invention.

Referring to FIG. 1-FIG. 10, the invention provides an adjustable multi-use chair, comprising two chair backs which are a first chair back 11 and a second chair back 12, a seat 3 and a chair leg 4, wherein the seat 3 is connected to the chair leg 4, and a pneumatic rod 41 for adjusting the height of the chair is arranged in the chair leg 4; the first chair back 11 is connected to the seat 3 by means of a connecting mechanism 13, and the second chair back 12 is connected to the first chair back 11 by means of a first angle adjustment mechanism 14; and the connecting mechanism 13 comprises a chair back lifting device 131 which has adjustment positions. When adjusted, the first chair back is lifted to drive the chair back lifting device to change its position, and after the first chair back is adjusted to a proper height, the chair back lifting device will be fixed automatically and does not need to be locked, thus simplifying operation steps; and when the first chair back needs to be lowered, the chair back lifting device can descend to the original position to lower the backrest from the highest position. The pneumatic rod 41 used for adjusting the height and rotation direction of the chair is arranged in the chair leg. The first angle adjustment mechanism 14 can adjust relative positions of the second chair back 12 and the first chair back 11. Generally, the angle between a backrest surface of the first chair back and a seat surface of the seat is the same as the angle between a backrest surface of the second chair back and the seat surface of the seat, such that the back of users can be supported when the users sit forward on the chair. In a case where the second chair back is folded by 90° in a direction away from the seat by means of the first angle adjustment mechanism, the second chair back is parallel to the seat, at this moment, the second chair back can be used as a desk or a small table and can store notebooks, books, tablet computers or other items, and users can turn around to sit on the chair to work comfortably. In a case where the second chair back is folded by 180° in a direction away from the seat by means of the first angle adjustment mechanism, the second chair back is next to the first chair back, and users can turn around to sit on the chair to use the desk or perform other operations without being interfered by the second chair back. If the second chair back cannot be adjusted to be next to the first chair back, the second chair back possibly abuts against the desk, and users cannot work comfortably with the desk, causing inconvenience. The chair can be adjusted in multiple ways, thus improving the degree of freedom in use and satisfying the requirements of users for changing the sitting position. A joint of the first chair back 11 and the connecting mechanism 13 is narrow, extends in a direction away from the seat, and expands smoothly to form a support part, and the backrest surface of the first chair back is approximately of an inverted triangular structure. The joint of the first chair back and the connecting mechanism is retracted inwards with respect to the support part to provide a space allowing users to place their thighs therein, such that the users can stretch their thighs freely when sitting backward on the chair, thus guaranteeing comfort to some extent.

The support part is in smooth transition with the joint, such that users can be protected against collisions when sitting backward on the chair. The first chair back allows users to change their sitting position directly in a case where the second chair back is folded by the users function as a desk, the second chair back does not need to be adjusted synchronously, and the back of the users can still be supported by the first chair back when the users sit forward on the chair, thus reducing, to some extent, the complexity of position changing. By adopting two chair backs, users not only can sit on the chair, but also can sleep on the chair, and the chair backs are large enough to support the head of the users when the users lie on the chair, thus providing good usage experience; and when the chair is transported, the second chair back can be folded to be attached to the first chair back, thus facilitating transportation, greatly reducing the transportation cost, and lowering the entry difficulty.

Further, the adjustable multi-use chair further comprises a first armrest 21 and a second armrest 22, wherein the first armrest 21 is connected to the seat 3 by means of a second angle adjustment mechanism 23, the second armrest 22 is connected to the seat 3 by means of a third angle adjustment mechanism 24, the second angle adjustment mechanism and the third angle adjustment mechanism are symmetrically arranged on two sides of the seat and connected to the first armrest and the second armrest respectively. By means of the two angle adjustment mechanisms, the angle between inner sides, close to the seat, of the two armrests and the seat surface of the seat can be adjusted to a plurality of angles from an acute angle to a reflex angle (greater than) 180°, and the two armrests can be adjusted separately. Any one of the two armrests can be adjusted to be flush with the seat, and users can laterally sit on the chair using the erected armrest as a backrest; at this moment, the second chair back can be adjusted to be parallel to the seat to function as a desk; the two armrests can be adjusted to be flush with the seat to allow users to lie on the side on the chair; and the angle between the inner sides of the two armrests and the seat surface of the seat can also be adjusted to 270°, at this moment, users can sit backward on the chair without being interfered by the armrests and can easily straddle on the chair, thus greatly optimizing usage experience.

Further, the second angle adjustment mechanism and the third angle adjustment mechanism each comprise a first rotating arm 231, a second rotating arm 232 and a return spring 233; two through grooves with L-shaped cross-sections are formed in the first rotting arm 231 and used for receiving a fixing block 2311 and a fixing elastic piece 2312, the fixing elastic piece is arranged in one of the through grooves and is not higher than the through groove, and one end of the fixing elastic piece abuts against the fixing block; the fixing block is arranged in the other through groove and is not lower than the through groove; the second rotating arm comprises two rotating disks, the first rotating arm is clamped between the two rotating disks, and tooth grooves 2321 are formed in the two rotating disks; and through holes allowing a rotating shaft to penetrate through are formed in the first rotating arm and the second rotating arm. When the armrests are adjusted from an initial state where the angle between inner sides of the armrests and the seat surface of the seat is minimum, the first rotating arm and the second rotating arm rotate axially with respect to the rotating shaft, one side of the fixing block of the first rotating arm is clamped between the two tooth grooves, the other side of the fixing block of the first rotating arm is clamped between the through grooves, and each tooth groove corresponds to one adjustment position; when the armrests need to be restored, the second rotating arm is deflected to an angle greater than the maximum adjustment angle, at this moment, the fixing block is separated from the fixing elastic piece, the second rotating arm is rotated to the initial position, the fixing elastic piece abuts against the fixing block again, and the armrests return to the normal state. The angle of the armrests can be easily adjusted by means of the second angle adjustment mechanism and the third angle adjustment mechanism, and the armrests can be adjusted, if necessary, only by applying a push force thereto, and unlocking, adjustment and locking of locking structures are not needed, such that adjustment is easy, and using convenience can be greatly improved. The return springs are fixed to the first rotating arms and can improve adjustment damping, thus guaranteeing smooth and gentle adjustment, and avoiding poor experience caused by an excessive deflection angle of the armrests when the armrests are slightly pushed. The return springs can also fulfill a limiting effect: when the armrests return to the initial state, the return springs are in a balanced state; when the armrests are deflected towards the seat surface of the seat to make the angle between the inner sides of the armrests and the seat surface of the seat less than that in the initial state, the return springs will be compressed to prevent the armrests against excessive deflection, thus protecting the fixing elastic pieces from being squeezed and damaged.

Further, an armrest bracket 25 and an armrest bracket adjustment device 26 are arranged in each armrest; the armrest bracket is fixed to one end of the armrest bracket adjustment device; the armrest bracket adjustment device 26 comprises a lifting rod 261, a lifting sleeve 262 with a lifting positioning groove, a positioning rod 263, an adjustment switch 264, a lifting rod inner sleeve 265 and an armrest bracket outer sleeve 266, through grooves 267 for receiving the positioning rod are formed in the lifting rod 261 and the lifting rod inner sleeve 265 respectively, the positioning rod is arranged in the through grooves 267, and the lifting rod 261 is arranged in the lifting rod inner sleeve 265; the lifting rod inner sleeve 265 is sleeved with the lifting sleeve 262, and the positioning rod 261 slides in the lifting positioning groove; the lifting positioning groove comprises a plurality of positioning grooves and a sliding groove connected with the positioning grooves, and the positioning rod is limited in any one of the positioning grooves; the lifting sleeve is sleeved with the armrest bracket outer sleeve, and the lifting sleeve is fixed to an inner wall of the armrest bracket outer sleeve; a through groove allowing the adjustment switch to penetrate through is formed in the armrest bracket outer sleeve, and one end of the adjustment switch is fixed to the lifting rod. When the armrest bracket needs to be adjusted, the adjustment switch is pressed to push the lifting rod to move inwards, at this moment, the positioning rod in the through groove slides into the sliding groove form one positioning groove, and at this moment, the armrest bracket can be lifted or lowered to adjust the height of the armrest bracket; after the height of the armrest bracket is adjusted, the adjustment switch is released, the lifting rod returns to the original position, and the positioning rod is squeezed by the through groove to slide into one positioning groove form the sliding groove, at this moment, the height of the armrest bracket is fixed, and adjustment is finished. The armrest brackets and the armrest bracket adjustment devices are arranged the two armrests.

Further, a rotating shaft 268 is arranged at an end, connected to the armrest bracket, of the armrest bracket adjustment device, and the armrest bracket is connected to the armrest bracket adjustment device by means of the rotating shaft. One end of the armrest bracket can be pushed to enable the armrest bracket to rotate axially around the rotating shaft, such that the position of the armrest bracket can be adjusted to allow users to lean thereagainst.

Further, a convex rib 15 is arranged at an end, away from the seat 3, of the second chair back 12. In a common state where the angle between the backrest surface of the first chair back and the seat surface of the seat is the same as the angle between the backrest surface of the second chair back and the seat surface of the seat, the convex rib can be used as a headrest, thus improving the comfort of the chair backs and protecting, to some extent, the neck of users; when the second chair back is folded by 90° in a direction away from the seat to function as a desk, the convex rib can fulfill a limiting effect to some extent; a mat of a computer is attached to the convex rib, and one end of the computer clines to the convex rib, such that the computer is less likely to slide when placed on the second chair back.

Further, the connecting mechanism 13 further comprises a sitting depth adjustment mechanism 132 for adjusting the distance between the first chair back 11 and the seat 3, the sitting depth adjustment mechanism is adjusted by means of a rotating handle 1321, and by rotating the rotating handle, the positions of clamping teeth connected to the rotating handle in an adjustment groove 1322 can be adjusted; and the connecting mechanism 13 further comprises four limiting grooves 1323, and the limiting grooves 1323 are parallel to the adjustment groove 1322 and used for limiting the position and moving direction of the seat (close to or away from the first chair back). Some users want to place their thighs on the seat to realize uniform stress and lean their back against the chair backs, some other users want to suspend their thighs to accelerate heat dissipation, and different users have different preferences; users with different figures will have different feelings when sitting on the chair, so the sitting depth adjustment mechanism is arranged to provide more options to satisfy the requirements of different users.

Further, a cushion is arranged on the seat, and two ends of the cushion extend out of the seat and wraps around two ends of the seat. Because the two ends of the seat are wrapped with the cushion, no matter whether users sit forward or backward on the chair, the two ends, in contact with the legs of users, of the seat are soft, thus providing good usage experience.

Further, the first chair back, the second chair back, the first armrest and the second armrest are all wrapped with cushions.

The Invention has the Following Advantages:

(1) The sitting depth and height of the chair, the angle of the chair backs and the angle of the armrests can be adjusted, so the degree of freedom of adjustment is extremely high, adjustment is easy, time and labor are saved, and both the degree of freedom and convenience of adjustment are guaranteed; different from chairs which can be freely adjusted and are inconvenient to use on the market, the adjustable multi-use chair has good usage experience;

(2) The chair has two chair backs, the upper chair back can be folded to function as a desk, and users can change the chair into an office chair anytime anywhere in use, so the degree of freedom in use is high; the lower chair back is connected to the seat by means of the connecting mechanism to function as a basic chair back, and when users change their sitting position from a backward sitting position where the upper chair back is folded for use to a forward sitting position, the back of the users can still be supported without adjusting the lower chair back, such that the users can adjust their sitting position anytime, and the defect of discomfort experience caused by complex chair adjustment performed when the users adjust their sitting position is avoided;

(3) The chair has two armrests which can be adjusted separately; when one of the armrests remains unchanged and the other armrest is adjusted to be flush with the seat, users can sit laterally on the chair with the unchanged armrest as a chair back; the when the two armrests are both adjusted to be flush with the seat, the chair can be used as a deck chair; when the two armrests are adjusted to be located below the seat, users can sit backwards on the chair; in this way, the chair can be adjusted in multiple ways;

(4) The chair backs and armrests can be easily adjusted by means of the angle adjustment mechanisms, and manual locking is not needed, such that the chair is easy to adjust and convenient to use.

The embodiments disclosed above are merely several specific ones of the invention, and the invention is not limited to the above embodiments. All variations conceived by anyone skilled in the art should fall within the protection scope of the invention.

What is claimed is:

1. An adjustable multi-use chair, comprising:

a seat and a chair leg;

two armrests respectively and symmetrically arranged on two sides of the seat;

a first chair back and a connecting mechanism, wherein the first chair back is connected to the seat by means of the connecting mechanism and has an end connected to the connecting mechanism; a joint of the first chair back and the connecting mechanism extends in a direction away from the connecting mechanism and expands smoothly in a direction perpendicular to a central axis of the connecting mechanism to form a support part; the connecting mechanism comprises a chair back lifting device used for driving the first chair back to ascend to be adjusted and descend to return;

a second angle adjustment mechanism;

a third angle adjustment mechanism;

a first angle adjustment mechanism; and a second chair back, wherein the second chair back is connected to the first chair back by means of the first angle adjustment mechanism, and the first angle adjustment mechanism has an end arranged on the support part and an end arranged on the second chair back; the first angle adjustment mechanism is used for adjusting an angle between a backrest surface of the second chair back and a seat surface of the seat to a plurality of angles from an acute angle to a reflex angle;

wherein an end of the second angle adjustment mechanism and an end of the third angle adjustment mechanism are symmetrically arranged on the two sides of the seat respectively; the two armrests are connected to the seat by means of the second angle adjustment mechanism and the third angle adjustment mechanism respectively; the second angle adjustment mechanism and the third angle adjustment mechanism are used for adjusting angles between inner sides of the armrests and the seat surface of the seat to a plurality of angles from an acute angle to a reflex angle; and the two armrests are adjusted separately.

2. The adjustable multi-use chair according to claim 1, wherein each said armrest is provided with an armrest bracket and an armrest bracket adjustment device, and the armrest bracket adjustment device has an end connected to the armrest bracket and an end fixed in the armrest and is used for adjusting a height of the armrest bracket; the armrest bracket adjustment device comprises a lifting rod, a lifting sleeve with a lifting positioning groove, and a positioning rod, a through hole allowing the positioning rod to penetrate through is formed in the lifting rod, and the positioning rod is arranged in the through hole; when the height of the armrest bracket is adjusted, the positioning rod slides in the lifting positioning groove; and after adjustment, the positioning rod is fixed in the lifting positioning groove.

3. The adjustable multi-use chair according to claim 1, wherein the second angle adjustment mechanism and the third angle adjustment mechanism each comprise a first rotating arm, a second rotating arm and a return spring, and the return spring is fixed to the first rotating arm and used for increasing return damping and guaranteeing that the second rotating arm returns to an initial state.

4. The adjustable multi-use chair according to claim 1, wherein a convex rib is arranged at an end, away from the seat, of the second chair back.

5. The adjustable multi-use chair according to claim 1, wherein a sitting depth adjustment mechanism is arranged at a joint of the connecting mechanism and the seat and has a plurality of adjustment positions for adjusting a distance from the first chair back to the seat.

6. The adjustable multi-use chair according to claim 1, wherein a pneumatic rod for adjusting a height and rotation direction of the chair is arranged in the chair leg.

7. An adjustable multi-use chair, comprising:

a seat and a chair leg;

two armrests respectively and symmetrically arranged on two sides of the seat;

a first chair back and a connecting mechanism, wherein the first chair back is connected to the seat by means of the connecting mechanism and has an end connected to the connecting mechanism; a joint of the first chair back and the connecting mechanism extends in a direction away from the connecting mechanism and expands smoothly in a direction perpendicular to a central axis of the connecting mechanism to form a support part; the connecting mechanism comprises a chair back lifting device used for driving the first chair back to ascend to be adjusted and descend to return;

a first angle adjustment mechanism; and a second chair back, wherein the second chair back is connected to the first chair back by means of the first angle adjustment mechanism, and the first angle adjustment mechanism has an end arranged on the support part and an end arranged on the second chair back; the first angle adjustment mechanism is used for adjusting an angle between a backrest surface of the second chair back and a seat surface of the seat to a plurality of angles from an acute angle to a reflex angle;

wherein each said armrest is provided with an armrest bracket and an armrest bracket adjustment device, and the armrest bracket adjustment device has an end connected to the armrest bracket and an end fixed in the armrest and is used for adjusting a height of the armrest bracket; the armrest bracket adjustment device comprises a lifting rod, a lifting sleeve with a lifting positioning groove, and a positioning rod, a through hole allowing the positioning rod to penetrate through is formed in the lifting rod, and the positioning rod is arranged in the through hole; when the height of the armrest bracket is adjusted, the positioning rod slides in the lifting positioning groove; and after adjustment, the positioning rod is fixed in the lifting positioning groove.

* * * * *